US006149073A

United States Patent [19]

Hickey et al.

[11] Patent Number: 6,149,073

[45] **Date of Patent: *Nov. 21, 2000**

[54] CERAMIC PLUNGER FOR INTERNAL COMBUSTION ENGINE HIGH PRESSURE FUEL SYSTEM

[75] Inventors: Dan K. Hickey; J. Victor Perr, both of Greenwood; David M. Rix, Columbus; Joseph C. Bentz, Columbus; Thomas M. Yonushonis, Columbus; Malcolm G. Naylor, Columbus, all of Ind.; Katsuhiro Shinosawa, Tokyo, Japan; John T. Carroll, III, Columbus, Ind.

[73] Assignee: Cummins Engine Company, Inc., Columbus, Ind.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/021,296

[22] Filed: Feb. 10, 1998

Related U.S. Application Data

[63] Continuation-in-part of application No. 08/803,511, Feb. 20, 1997, Pat. No. 5,899,383, which is a continuation of application No. 08/245,589, May 18, 1994, abandoned, and a continuation-in-part of application No. 08/556,391, Nov. 9, 1995, abandoned, which is a continuation-in-part of application No. 08/245,589.

[51] Int. Cl.[7] ..... F02M 47/02; F02M 45/50

[52] U.S. Cl. ..... 239/89; 239/95; 239/96

[58] Field of Search ..... 239/96, 95, 89

[56] References Cited

U.S. PATENT DOCUMENTS

| | | | |
|---|---|---|---|
| 3,510,062 | 5/1970 | Watman | 239/96 |
| 5,094,215 | 3/1992 | Gustafson . | |
| 5,215,449 | 6/1993 | Llija | 417/462 |
| 5,409,165 | 4/1995 | Carroll, III et al. . | |
| 5,423,302 | 6/1995 | Glassey . | |
| 5,611,317 | 3/1997 | Peters et al. . | |

FOREIGN PATENT DOCUMENTS

| | | |
|---|---|---|
| 0683314A1 | 11/1995 | European Pat. Off. . |
| 58-146879 | 10/1983 | Japan . |
| 61-70585 | 5/1986 | Japan . |
| 62-54283 | 4/1987 | Japan . |
| 3-88972 | 4/1991 | Japan . |
| 6-159180 | 6/1994 | Japan . |
| 8-42382 | 2/1996 | Japan . |
| 8-105362 | 4/1996 | Japan . |
| 9-14035 | 1/1997 | Japan . |

OTHER PUBLICATIONS

Bosch Diesel Distributor Injection Pump Systems–Modular Concept and Further Development, H.E. Tschoke et al., pp. 138–143.

A new high pressure distributor pump for mid–range diesel engines, Idjordjevic Msae et al., pp. 45–62.

*Primary Examiner*—Kevin Weldon

*Attorney, Agent, or Firm*—Nixon Peabody LLP; Charles M. Leedom, Jr.; Eric J. Robinson

[57] ABSTRACT

A wear and scuff-resistant plunger for use in high pressure fuel system components in internal combustion engines is provided. The plunger, which is formed of a high thermal expansion, high hardness ceramic with a thermal expansion coefficient preferably greater than $6\times10^{-6}/°$ C. and a hardness preferably greater than 800 $Kg/mM^2$, maintains a desired optimum minimal diametral clearance while avoiding excessive fuel leakage and efficient plunger function without scuffing or sticking under the high axial, side and pressure loads and variable quality fuels encountered in the fuel system operating environment. Preferred high thermal expansion, high hardness ceramics are zirconia, alumina-zirconia and alumina.

18 Claims, 8 Drawing Sheets

100
118
4b
120
112
110
102
116
114
109
104
106
108

CERAMIC PLUNGER FOR INTERNAL COMBUSTION ENGINE HIGH PRESSURE FUEL SYSTEM

This application is a continuation-in-part of U.S. patent application Ser. No. 08/803,511, filed Feb. 20, 1997 now U.S. Pat. No. 5,899,383, which is a continuation of Ser. No. 08/245,589, filed May 18, 1994 now abandoned, a continuation-in-part of Ser. No. 08/556,391, filed Nov. 9, 1995, now abandoned and which is a continuation-in-part of Ser. No. 08/245,589, filed May 18, 1994 now abondoned.

TECHNICAL FIELD

The present invention is directed generally toward plungers for high pressure fuel systems and high pressure fuel system components, and particularly to a scuff-resistant high performance plunger made of a high hardness, high thermal expansion ceramic material.

BACKGROUND OF THE INVENTION

The components of internal combustion engine fuel systems, particularly those engines that demand the supply of a regulated quantity of high pressure fuel to the cylinders, must ideally function without failure for thousands of hours. Plungers used to pressurize fuel and regulate the timing and/or the quantity of fuel delivered to the combustion chamber are integral fuel system components.

Fuel system plungers and other components are required to operate under extremely adverse environmental conditions over a wide range of operating temperatures in injectors, pumps and other assemblies where heavy mechanical loads may be applied in both axial and lateral or side directions to the plunger and/or other components. As the plunger reciprocates axially in its bore, the temperature of both the plunger and the bore wall increase. In a high pressure fuel system, the plunger may be required to reciprocate within a bore distorted by the axial and lateral or side loads applied to the plunger during engine operation. As a result, the original diametral clearance is not maintained, and the plunger is forced against the distorted bore wall during engine operation, which produces wear, scuffing, sticking, and, ultimately, failure. Additionally, low quality and contaminated fuels contribute to the creation of an adverse fuel system plunger operating environment. The types of fuels increasingly used in diesel engines, particularly fuels with low lubricity, alternative fuels and fuels which may be contaminated with water, usually require special parts or adjustment to enable the fuel system to function optimally. Ideally, reciprocating plunger components must be scuff-resistant to maintain efficient engine operation. The presence of fuel contaminants of all kinds, especially water, increases the propensity of conventional plungers to stick, scuff and seize.

The material used to form fuel system plungers has been modified throughout the years in an effort to make a plunger that is both scuff-resistant and wear-resistant and capable of functioning as required under the adverse conditions of the fuel system environment. Metal plungers have experienced unacceptable repair and failure levels. Moreover, the presence of third body debris interferes with efficient fuel system function when metal plungers are employed in high pressure fuel systems. Third body debris includes particles from the plunger or the fuel system component bore wall as well as fuel contaminants that are not intended to be present within the fuel system. These particles become embedded into the plunger surface, effectively decreasing the diametral clearance, and ultimately cause the plunger to be wedged to the bore wall so that the plunger cannot reciprocate in the bore and, thus, becomes friction welded or seizes. The reduction of fuel lubricity, which could be caused by water contamination of the fuel, and may be a characteristic of some alternative fuels, can also be a major factor contributing to the friction welding or seizure of a plunger within a fuel system component bore. Fuel system operation is, of course, prevented if this occurs.

In addition to permitting the fuel system plunger to reciprocate freely within its bore, the maintenance of an optimum, minimal diametral clearance between the plunger and the bore wall prevents excess fuel leakage. Some fuel leakage around the plunger is necessary for lubrication as the plunger reciprocates during operation of the high pressure fuel system. Excess fuel leakage, however, interferes with efficient fuel distribution and/or injection, which prevents efficient engine operation and may even completely prevent engine operation.

The prior art has proposed the use of wear-resistant materials and corrosion-resistant materials to form various structures and components of internal combustion engines. For example, U.S. Pat. No. 4,794,894 to Gill and U.S. Pat. No. 4,848,286 to Bentz are directed to ceramic tipped pivot rods, and U.S. Pat. No. 4,806,040 to Gill et al. is directed to a ceramic ball and socket joint. U.S. Pat. No. 4,266,729 to Kulke et al. discloses forming an injector valve needle tip and/or disc from a corrosion-resistant material, such as high quality steel, ceramic, or industrial glass. U.S. Pat. No. 5,409,165 to Carroll, III et al. discloses a wear-resistant fuel injector plunger assembly with a tip made of an impact wear-resistant ceramic and a body that may be made of a ceramic or a metal. The tip and body are specifically configured to be secured together to withstand the high temperatures and frictional forces produced by prolonged motoring. However, neither of these two patents nor any of the prior art of which the inventors are aware, addresses the specific problems of high pressure fuel system plunger scuffing and sticking which are encountered with available fuel systems, particularly those used in diesel engines. The prior art, moreover, also does not provide a high pressure fuel system plunger capable of maintaining an optimum minimal diametral clearance between the plunger and bore wall to prevent excessive fuel leakage.

The prior art, therefore, has failed to provide a plunger for a high pressure fuel system that is sufficiently scuff-resistant and wear-resistant, particularly when exposed to third body debris and such adverse operating conditions as low lubricity and contaminated fuels and heavy mechanical loads, to operate efficiently without requiring frequent repair or replacement. A need exists for such a high pressure fuel system plunger.

SUMMARY OF THE INVENTION

It is a primary object of the present invention, therefore, to overcome the disadvantages of the prior art and to provide a scuff-resistant plunger for a high pressure fuel system for an internal combustion engine powered by fuels of varying quality, particularly fuels having varying degrees of lubricity.

It is another object of the present invention to provide a high pressure fuel system reciprocating plunger that is made from a wear- and scuff-resistant ceramic material and is sized relative to the bore within which it reciprocates to maintain an optimum minimal diametral clearance during fuel system operation over a wide range of operating temperatures.

It is a further object of the present invention to provide a high pressure fuel system plunger for a diesel engine capable of reliable, scuff-free operation at a minimal diametral clearance in the presence of high axial and/or side loads on the plunger.

It is yet another object of the present invention to provide a reliable, repair-free internal combustion engine high pressure fuel system plunger.

It is yet a further object of the present invention to provide a wear and scuff-resistant plunger for an internal combustion engine high pressure fuel system that is made of a zirconia, alumina-zirconia or alumina ceramic having a hardness greater than 800 $Kg/mm^2$ and a thermal expansion coefficient greater than $6\times10^{-6}/°$ C.

It is a still further object of the present invention to provide a ceramic plunger for an internal combustion engine high pressure fuel system made of a transformation toughened zirconia.

It is still another object of the present invention to provide a wear and scuff-resistant ceramic plunger for an internal combustion engine high pressure fuel system which avoids the varnish build-up associated with metal fuel system plungers.

It is yet another object to provide a scuff and wear-resistant plunger for a high performance fuel system pump for supplying high pressure fuel directly or indirectly to the cylinders in an internal combustion engine, said plunger being operably positioned to reciprocate at a minimal optimum diametral clearance of 76 to 128 millionths of an inch within an axial bore in the fuel system pump body to deliver a controlled volume of trapped, high pressure fuel at desired intervals directly or indirectly to the one or more engine cylinders, wherein said plunger is made of a wear-resistant high hardness, high thermal expansion ceramic material having a thermal expansion coefficient greater than $6\times10^{-6}/°$ C. and a hardness greater than 800 $Kg/mm^2$, and the plunger is sized relative to said axial bore to maintain said optimum diametral clearance therewith to reciprocate freely within said bore without sticking during fuel system pump operation.

The foregoing objects are achieved by providing a high pressure fuel system plunger for use in pumping units of high pressure accumulator and other fuel systems in internal combustion engines that is wear- and scuff-resistant and maintains a sufficient minimal diametral clearance within the bore where it is positioned so that the plunger can reciprocate freely without sticking, even under adverse engine operating conditions. The plunger is formed from a scuff-resistant ceramic material with a high hardness of greater than 800 $Kg/mm^2$ and a high thermal expansion coefficient greater than $6\times10^{-6}/°$ C. and is sized to provide an optimum, minimal operating clearance of 76 to 128 millionths of an inch with the wall of the bore within which it reciprocates to prevent fuel leakage around the plunger during engine operation.

Other objects and advantages will be apparent from the following description, claims and drawings.

DESCRIPTION OF THE PREFERRED EMBODIMENTS

Figure 1:
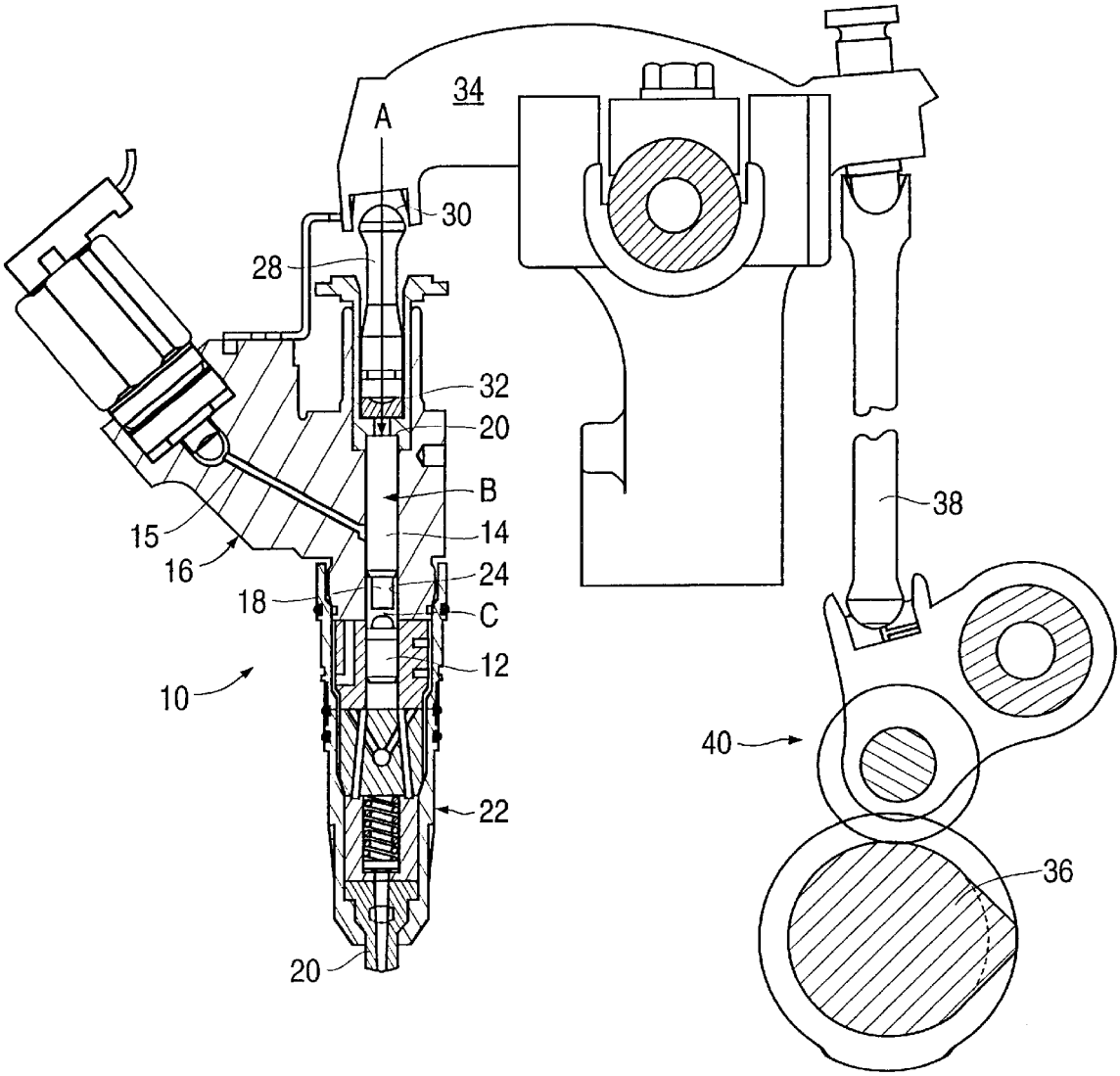
FIG. 1 is a schematic cross-sectional view of a high pressure fuel injector assembly in a diesel engine wherein both a timing plunger and a metering plunger are scuff-resistant, anti-stick plungers made of ceramic according to the present invention.

The efficient operation of a high pressure fuel system requires that the plungers in the system reciprocate freely without scuffing and sticking while maintaining a minimal diametral clearance with the bores in which the plungers reciprocate. Fuel system plunger scuffing and sticking is one cause of high fuel system repairs, usually expressed as RPH or repairs per hundred. In addition, high warranty and repair costs result from the replacement of failed and inoperable fuel system plungers. The high pressure fuel system plunger of the present invention is a reliable, wear-resistant plunger that does not stick or scuff, even when exposed to extremely abusive engine operating conditions and low lubricity fuels. Consequently, the present invention effectively lowers both the incidence of repairs and the warranty costs occasioned by failed and inoperable fuel system plungers.

The plungers of the present invention are generally integral components of high pressure fuel systems and are used to pressurize fuel and regulate the timing and/or quantity of fuel delivered directly or indirectly to the engine combustion chamber. Such plungers all force a trapped volume of fuel in the "barrel" or bore in which the plunger is reciprocally positioned and pressurize the trapped fuel to a very high level. Fuel pressurized by the plungers of the present invention may reach pressures as high as 24,500 psi or more. It has been discovered that forming a fuel system plunger of a high thermal expansion, high hardness, scuff-resistant ceramic allows the plunger to reciprocate within a mated bore, which is generally formed in a metal body, at very tight operating clearances throughout the entire range of fuel system operating pressures and temperatures without the sticking, scuffing or seizing characteristic of metal plungers. The difference in the atomic structures of the ceramics preferred for the present invention and the steel usually used to form the fuel system element containing the bore in which the plunger reciprocates causes the ceramic plunger and metal bore wall to resist the reciprocal transfer of the material upon direct contact during the plunger pumping stroke. Plungers formed from steel have a much greater tendency to transfer material back and forth between the bore wall and the plunger during incidental contact. Such contact is caused, for example, by high bending loads on the plunger, distortion of the bore, loss of the lubricant film, and the presence of third body debris during fuel system operation. Moreover, the presence of contaminants of all kinds in fuel increases the propensity of conventional plungers to stick, scuff and seize. Water is a fuel contaminant that has particularly egregious effects on plunger operation.

The diametral or annular clearance between the largest diameter length of the plunger and the wall of the bore in which the plunger is positioned to reciprocate may be made as small as required to optimize fuel flow through the clearance. Some fuel must flow through the clearance between the plunger and the bore wall to provide the lubrication necessary to enable the plunger to reciprocate within the bore at the high fuel pressures and high external loads characteristic of fuel system operation. However, if the clearance is too great, excess fuel will leak around the plunger, and the high fuel pressures required for efficient fuel system operation will not be maintained. Prior art metal plungers are also subject to wear which could cause excessive leakage over time, even if the initial diametral clearance is optimal.

The drawings illustrate exemplary uses of the ceramic fuel system plunger of the present invention. It is anticipated that this ceramic plunger can be effectively employed in diverse engine fuel system environments where a plunger is required to deliver to the engine combustion chamber or cylinders, either directly or indirectly, high pressure fuels that may be contaminated or have low lubricity in the presence of high external forces, particularly high axial and/or side loads. Such plungers may function, for example, as unit injector upper plungers or injector or fuel pump timing plungers or pumping plungers in mid-range, high horsepower and heavy duty engines.

Referring to the drawings, FIG. 1 illustrates, in schematic cross section, one embodiment of the plunger of the present invention in an open nozzle high pressure unit fuel injector 10 with a timing assembly of the type that includes a timing plunger 14. U.S. Pat. Nos. 5,094,215 and 5,611,317 disclose unit fuel injectors of the type shown in FIG. 1. The disclosures of these patents are hereby incorporated herein by reference. As illustrated in FIG. 1, the timing plunger 14 forms part of a multiple part plunger assembly including a metering plunger 12. Timing plunger 14 and metering plunger 12 form a collapsible timing chamber into which fuel (or another type of timing fluid) may be metered on a cycle-by-cycle basis to regulate the timing of the delivery of fuel directed from a fuel supply (not shown) through a fuel passage 15 in the fuel injector body 16 to the injector nozzle 20. The specific configuration of the timing plunger is not critical. The timing plunger 14 includes a projection 18 which may support a spring (not shown) for biasing the timing plunger upwardly. Other configurations of timing plunger may also be formed of ceramic in accordance with the present invention. The injector nozzle 20 and the body 16 are axially aligned and held together by a retainer 22. An axial bore 24 extends throughout the length of the body 16 and is in fluid communication with the injector nozzle 20. A plurality of spaced injection orifices (not shown) are provided at the terminus of the injector nozzle 20 to optimize the injection of high pressure fuel into the engine cylinder (not shown).

The timing plunger 14 reciprocates axially within the bore 24 in the injector body 16. Downward force is applied to metering plunger 12 by a link 28, one end 30 of which is engaged by a rocker lever 34. The other end 32 of the link 28 contacts directly or indirectly the metering plunger 12 during engine operation and applies downward force to the timing plunger 14 through the timing fluid metered and trapped in the metering chamber formed therebetween. The rocker lever 34 is drivingly connected to the engine camshaft 36 through a pushtube 38 and a cam follower 40. The rocker lever 34 typically applies both axial and side loads to the timing plunger 14 during engine operation. Arrow (A) represents the axial load applied to the plunger 14 by the rocker lever 34. Arrow (B) represents the side load applied to the plunger 14 by the rocker lever 34. The axial load applied by the rocker lever 34 to the timing plunger 14 as it reciprocates in the injector body 16 can be as high as 2400 pounds. In addition to these axial and side loads, pressures as high as 24,500 psi and greater are generated by the timing plunger's downward stroke as it travels toward the injector nozzle 20. This pressurizes the fuel trapped in the cavity (C) between the timing and metering plungers and results in a load of 24,500 psi or more acting on the timing plunger 14 in an upward axial direction and on the metering plunger 12 in a downward axial direction. As shown in FIG. 1, this pressure is applied to the entire face of the timing plunger 14, including to the face of the timing plunger projection 18.

The ceramic timing plunger 14 is sized relative to the diameter of the injector body bore 24 to provide an optimal minimum diametral clearance. Preferably this diametral clearance is in the range of 76 to 128 millionths (0.000076 to 0.000128) of an inch (1.93 to 3.25 microns). The diametral clearance can be less than that of prior known plunger designs due to differences in thermal expansion between the currently available stainless steel plunger and the ceramic timing plunger 14 of the present invention. The aforementioned loads on the timing plunger and the clamp load on the injector body 16 often distort the axial bore, which decreases the diametral clearance. The rocker lever generated side load (arrow B) then forces the timing plunger 14 against the wall of the bore 24. Plunger scuffing and wear occur under such circumstances. The presence of third body debris in the injector body bore compounds the plunger problems under these loads.

Both the timing plunger 14 and the metering plunger 12 of the plunger assembly of FIG. 1 are subjected to the same kinds and degrees of axial and side loads. In addition, the diametral clearances between the timing plunger 14 and the wall of the axial bore 24 and between the metering plunger 12 and the wall of the axial bore 24 must be as small as possible to avoid excess fuel leakage. As discussed above, a diametral clearance on the order of 76 to 128 millionths of an inch for both plungers is desirable. Forming both the timing plunger and the metering plunger from a high thermal expansion ceramic in accordance with the present invention permits the maintenance of this very small diametral clearance under the high axial and side loads encountered during injector operation without scuffing, even in the presence of poor quality, low lubricity fuels.

Figure 2:
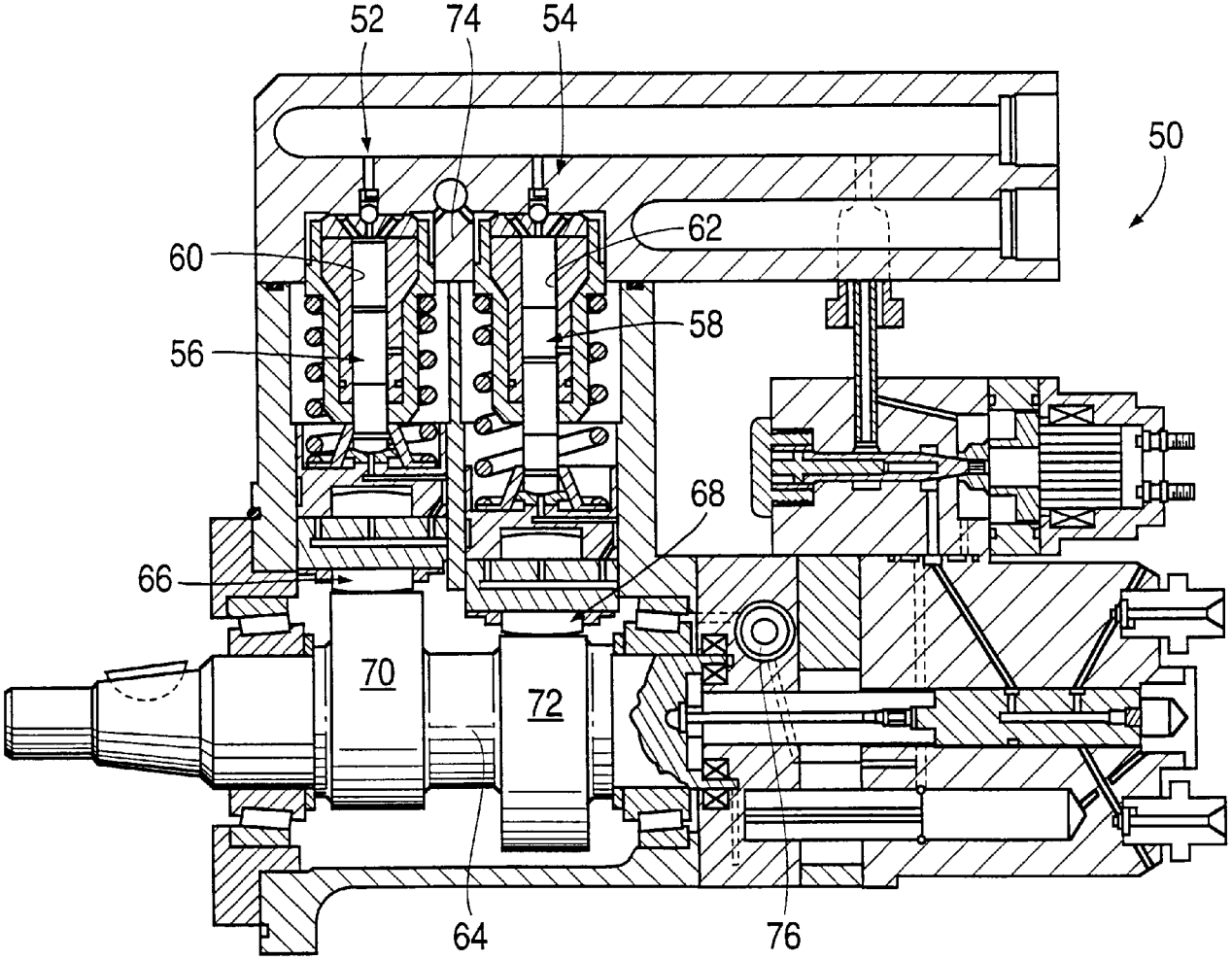
FIG. 2 illustrates an engine fuel system accumulator pump system incorporating ceramic pumping plungers in accordance with the present invention.

FIG. 2 illustrates an accumulator fuel pump system 50 of the type illustrated in PCT Patent Publication WO 94/27041, entitled "Compact High Performance Fuel System," commonly assigned to the assignee of the present application, the disclosure of which is incorporated herein by reference. This accumulator pump-type fuel injection system includes a distributing device 51, i.e., a rotary distributor 51*a*, positioned downstream of a high pressure accumulator 74 continuing multiple cavities 53*a* and 53*b* for distributing fuel pulses to each injector via separate delivery lines, and a timing and metering device 55 positioned along the fuel circuit between the accumulator 74 and distributing device 51 for determining the timing and metering of injection. A high pressure fuel pump 57 operates to maintain the fuel in the accumulator 74 at an extremely high pressure for injection into the engine. The high pressure pump 57 includes two pump units 52 and 54, each including a pump plunger 56 and 58, respectively, reciprocally mounted at an optimum minimal diametral clearance in a respective bore 60, 62 formed in a pump barrel connected to the accumulator. Each pump plunger is operated by a camshaft 64 and a respective tappet assembly 66, 68 positioned between the plunger 56, 58 and a cam 70, 72 on the camshaft 64. The system disclosed has been modified in accordance with the subject invention by the use of ceramic pumping plungers 56, 58. The pumping plungers 56, 58 are required to reciprocate within respective axial bores 60, 62 to cause fuel to be pumped at very high pressure into a high pressure accumulator 74 in an amount sufficient to maintain a desired pressure within the accumulator. A low pressure accumulator 76 is provided upstream of the pumping units 52 and 53 to assure that a sufficient supply of fuel will be available even during periods in which the engine requires high volumes of fuel. Fuel flows from low pressure accumulator 76 to the pumping units 52 and 53 through a series of passages not illustrated. The pumping plungers of this system are required to supply all of the fuel necessary for fueling all of the cylinders of an engine and may therefore need to supply the fuel for three or more cylinders. Maintenance of sufficient pressure (e.g., 30,000 psi or more) within the high pressure accumulator 74 is essential for satisfactory operation of the system. Failure of any one of the pumping units could cause a serious malfunction of the fuel system. Therefore, predictable reliable operation of each pumping unit over extended periods without experiencing maintenance or repair steps is required. Use of ceramic pumping plungers of the subject type having a close diametral clearance within the bore in which they are mounted can assist in meeting this requirement. Fuel stored in the accumulator is distributed by this type of fuel system pump to injection nozzles located at each cylinder of the engine. Additional pumping units including identical ceramic pumping plungers positioned to reciprocate within an axial bore may also be included in the system of FIG. 2. As in the fuel injector shown in FIG. 1, the plungers 56 and 58 are required to reciprocate within respective axial bores 60 and 62, ideally at minimal diametral clearances that keep fuel leakage at an optimum minimum level, to deliver high pressure fuel into the high pressure accumulator 74 as needed for engine operation. The use of a ceramic as disclosed herein to form the pumping plungers 56 and 58 substantially eliminates the scuffing caused by the high side loads on the plungers.

Figure 3A:
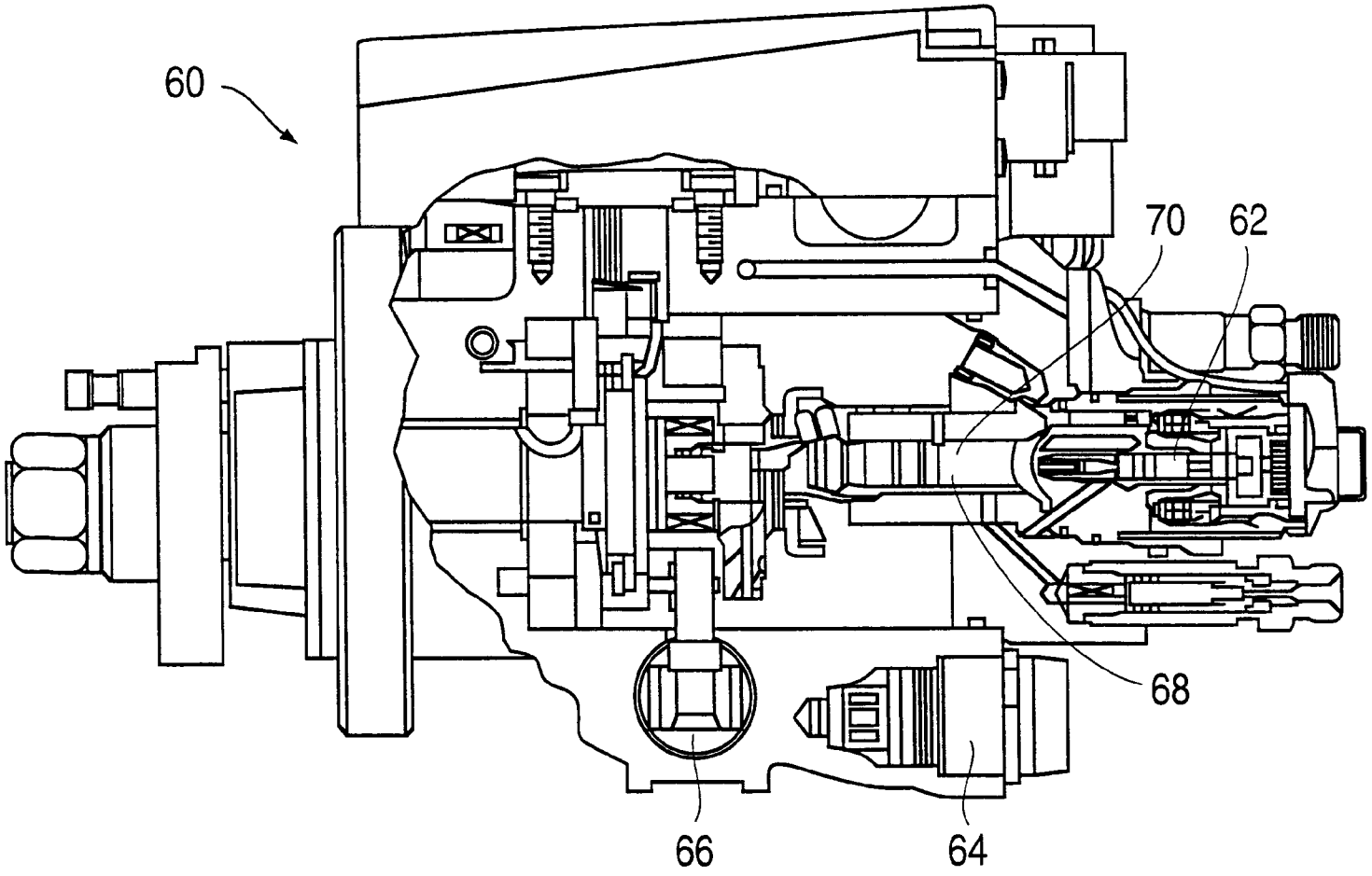
FIGS. 3*a*, 3*b* and 3*c* illustrate solenoid valve-controlled fuel distributor pumps with ceramic pump plungers in accordance with the present invention.
Figure 3C:
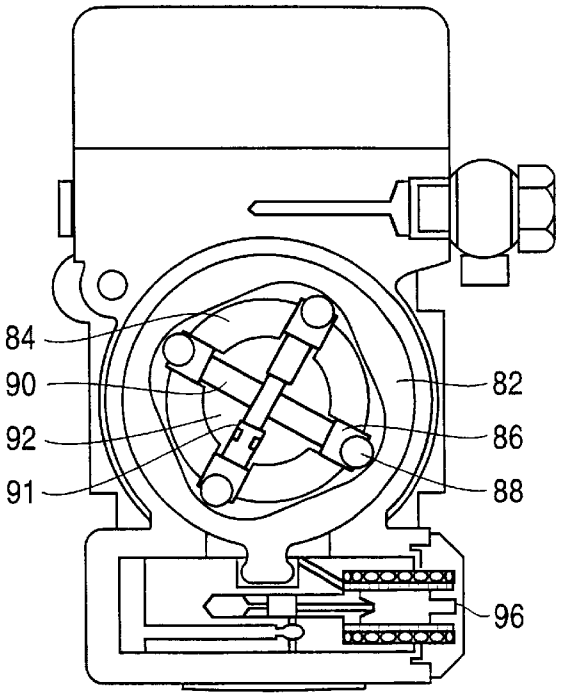
Figure 3B:
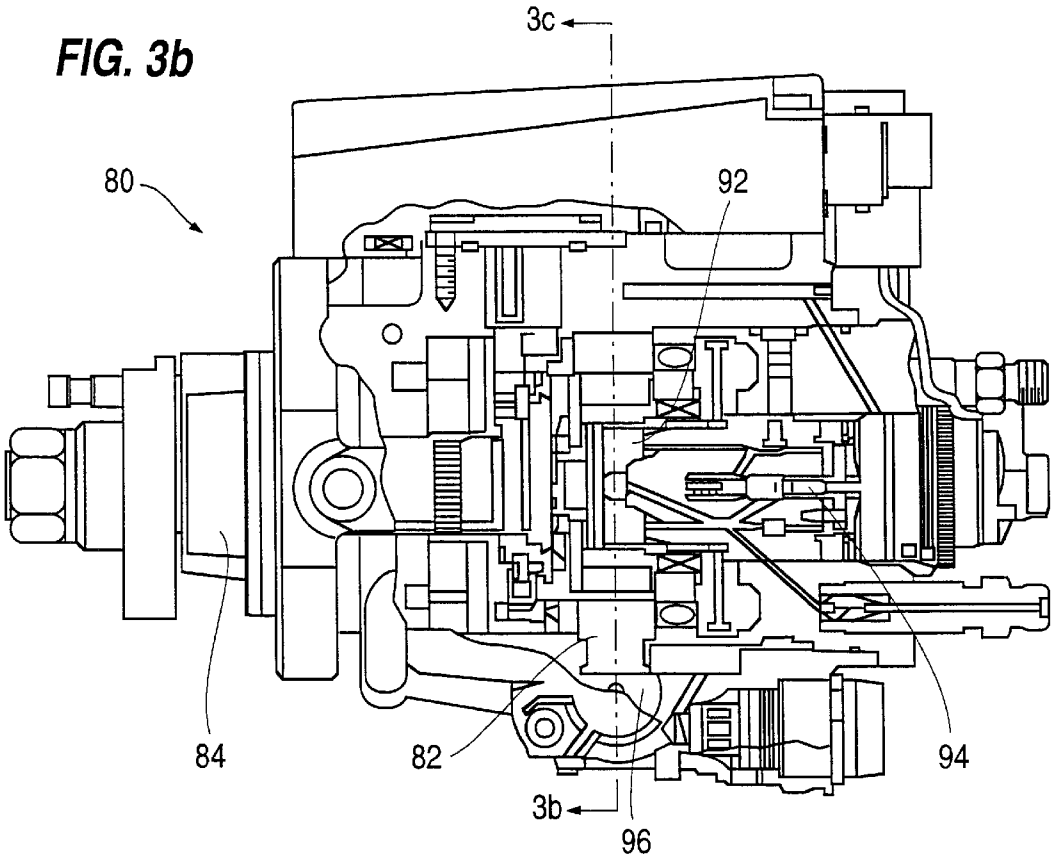

FIGS. 3*a*, 3*b* and 3*c* illustrates two types of solenoid valve-controlled fuel distributor pumps. These pumps are described in SAE Paper 945015 entitled *Bosch Diesel Distributor Injection Pump Systems—Modular Concept and Further Development*, the disclosure of which is incorporated herein by reference.

The distributor pump 60 shown in FIG. 3*a* is a solenoid valve-controlled axial piston type of fuel distributor pump. This type of pump employs a time-controlled fuel metering system and generates nozzle-side injector pressures in the range of about 13,000 to 14,000 psi. A high pressure solenoid valve 162 is provided for fuel metering. This type of pump also includes timing device solenoid valve 164 which controls a timing device piston 166 by modulating the fluid pressure applied to timing device piston 166 via a fluid passageway not illustrated. A cam mechanism 167 operates to cause piston 168 to reciprocate in bore 170. closing of solenoid valve 162 defines the start of delivery of fuel and the length of time the valve remains closed defines the injected fuel quantity. In order that the rate of injection can be varied, the solenoid valve's closing point (which controls the start of delivery) can be selected as required on the cam at different cam velocities. The timing device solenoid valve 164 compensates for the resulting changes in the start of delivery or start of injection. High pressure solenoid valve 162 that is actuated to control fuel delivery by an axial piston 168 in bore 170. Axial piston 168 forms a high pressure chamber 169 in bore 170 from which fuel is directed to individual engine cylinders under the control of valve 162. The axial loads on the piston or plunger 168 in this type of pump are likely to cause the plunger 168 to be forced against the wall of the bore 170 at tight clearances. The timing device piston 166 and the axial piston 168 are both made of a high hardness, high thermal expansion coefficient, scuff-resistant ceramic and sized to maintain an optimum minimal diametral clearance with their respective bores in accordance with the present invention.

FIGS. 3*b* and 3*c* are two different views of a solenoid valve-controlled radial piston fuel distributor pump 80. A radial piston fuel distributor pump is capable of producing higher pump pressures and, therefore, higher injection pressures, in the range of about 20,000 to 21,000 psi, than an axial piston fuel distributor pump such as that shown in FIG. 3*a*. The pump of FIGS. 3*b* and 3*c* is likely to be used in different engine applications than the pump in FIG. 3*a*. The radial piston pump of FIGS. 3*b* and 3*c* generates pressure forces that can be supported through the shortest possible distance through a cam drive mechanism including a cam ring 82 with an internal cam contour. The required high pressure hydraulic performance is achieved due to a high level of transmission-element rigidity from the drive up to the pressure generation stage, coupled with a low dead volume in the pump's high pressure area, low hydraulic power loss during the delivery stroke, and a high rate of delivery compared to the axial piston stroke. As shown in FIG. 3*c*, which is a view of pump 80 taken along lines 3*c*–3*c* of FIG. 3*b*, the pump drive shaft 84 has guide slots for the roller shoes 86 that support rollers 88 positioned about the drive shaft 84. A high pressure delivery plunger 90 is associated with each roller 88 and roller shoe 86 and is positioned at an optimal minimum diametral clearance within an associated radial bore 91 in a rotating distributor shaft 92. Each piston or plunger 90 reciprocates within its radial bore 91 to deliver high pressure fuel to an engine injector. The radial bores 91 communicate with a centrally located high pressure chamber 93 (FIG. 3*c*) which communicates with needle valve 94 through passage 95 (FIG. 3*b*). A solenoid valve needle 94 is integrated in the distributor shaft 92 to provide enhanced control of fuel delivery. A timing device piston 96 further enhances fuel metering accuracy. As is apparent from FIG. 3*c*, cam ring 82 may be rotated under control of timing device delivery piston 96 as it reciprocates within bore 97 to change injection timing. The high pressure delivery pistons 90 are formed of a high hardness, high thermal expansion coefficient, scuff-resistant ceramic in accordance with the present invention to substantially eliminate repairs of the pump due to wear and/or failure of these pump components. The timing device delivery piston 96 can also be formed of a high hardness, high thermal expansion coefficient, scuff-resistant ceramic in accordance with the present invention to produce a radial piston electronic fuel distribution pump with greatly enhanced service life.

Figures 4A, 4B:
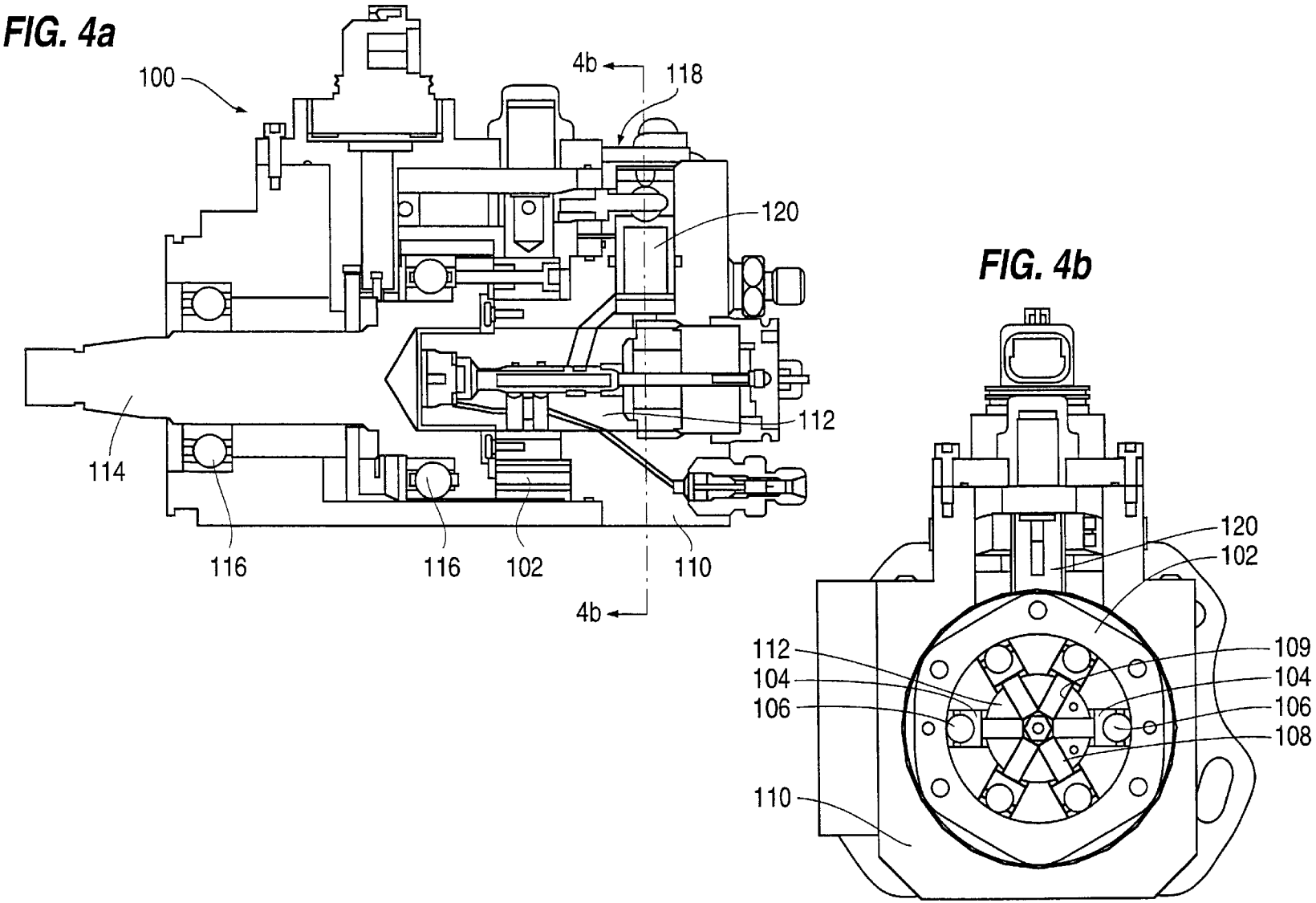
FIGS. 4*a* and 4*b* illustrate two views of a high pressure fuel distributor pump with ceramic pump plungers in accordance with the present invention.

FIGS. 4*a* and 4*b* illustrate a high pressure distributor pump suitable for mid-range diesel engines that can be fitted with high hardness, high thermal expansion coefficient, scuff-resistant ceramic plungers or pistons in accordance with the present invention. FIG. 4*b* is a section of the pump of FIG. 4*a* taken along line 4*b*–4*b* of FIG. 4*a*. This type of pump is described in SAE Paper No. 954126 entitled *A new high pressure distributor pump for mid-range diesel engines* by I. Djordjevic et al., the disclosure of which is incorporated herein by reference.

The fuel pump of FIGS. 4*a* and 4*b* is a high pressure (140 mPa), electronically controlled rotary distribution pump for 3, 4, 5 and 6 cylinder mid-range diesel engines. This pump uses one of the pumping elements at a time to act as a distribution port, which allows the radial pumping elements and centralized control valve to be fixed in place in the head assembly. The pump 100 of FIGS. 4*a* and 4*b* operates using an internal cam ring 102 to actuate shoes 104 and rollers 106. Each shoe 104 and roller 106 drives a pumping plunger 108, which reciprocates in a bore 109 and is sized relative to the bore 109 to maintain an optimum minimal diametral clearance therewith. The number of shoe/roller/plunger sets is equal to, or proportional to, the number of pump outlets. The shoes, rollers and plungers are contained in a stationary hydraulic head assembly portion 110 of the pump 100. The shoes 104 and rollers 106 are guided in slots (not shown) in the head. The high pressure plungers 108 are precision fit in the bores 109 in a sleeve 112 inside the head 110. The cam ring 102 turns with, and is bolted to, a drive shaft 114 supported by bearings 116. The high pressure plungers 108 are formed of a high hardness, high thermal expansion coefficient, scuff-resistant ceramic in accordance with the present invention to produce a low maintenance fuel pump.

The pump 100 of FIG. 4*a* also includes a transfer pump section 118 with a transfer pump piston 120 which is driven by a lever 121 connected to a transfer pump tappet 119 which in turn, is driven by the external profile of the cam ring 102. The transfer pump piston 129 serves to provide "charging" fuel to the bores 109. The transfer pump piston 120 is also preferably formed of a high hardness, high thermal expansion coefficient ceramic in accordance with the present invention. Forming all of the plungers and pistons of the fuel distribution pump of FIGS. 4*a* and 4*b* of a high hardness, high thermal expansion coefficient, scuff-resistant ceramic produces a substantially repair-free, efficient pump.

The foregoing uses of the ceramic plunger of the present invention are intended to be exemplary only. Other fuel system components that employ plungers subject to undesirable high axial and/or side loads to pump high pressure fuel will also benefit from the use of a ceramic plunger as described herein to replace a metal plunger. A specific example is the plunger associated with the intensifier piston of the hydraulically-actuated fuel injector shown and described in U.S. Pat. No. 5,423,302, the disclosure of which is hereby incorporated herein by reference. Forming this plunger from a scuff-resistant ceramic should achieve the same beneficial results achieved for timing plungers as described below. Other fuel system uses and applications for the ceramic plunger of the present invention are intended to be encompassed by the present invention.

The severity of the fuel system plunger operating environment is further increased by low sulfur and low lubricity fuels and fuels contaminated by water. Until the present invention, a fuel system plunger that is scuff and wear-resistant and capable of functioning without sticking or failure under the adverse conditions encountered in a fuel system operating environment has not been available. The present invention provides a plunger assembly for an internal combustion engine fuel system with a substantially higher resistance to scuffing and sticking than the plungers currently in use. It has been discovered that forming the plunger of a hard, wear-resistant ceramic material avoids the scuffing and sticking problems that have plagued steel and other metal plungers and, additionally, resists the axial and side loads applied to high pressure fuel system plungers during engine operation more successfully than available plungers. A ceramic plunger presents many advantages. The kinds of ceramic materials found to be suitable for fuel system plungers in accordance with the present invention are much harder than the materials currently used for either the plunger or the fuel system component surrounding the bore containing the plunger. Moreover, the preferred plunger ceramic material has a low reactivity and a low weld affinity with petroleum lubricated metal counterfaces. However, the optimum surface finish must be created on the ceramic plunger for the best sliding wear performance.

High pressure fuel system plungers made from high hardness, high thermal expansion ceramics, including zirconia, alumina-zirconia and alumina, have been demonstrated to show significantly better scuffing resistance than plungers made from metal. Although other ceramics, most notably silicon nitride, also display superior scuff resistance, only high thermal expansion ceramics have been found to be suitable for use in forming high pressure fuel system plungers. A particularly effective ceramic for this purpose is a stabilized zirconia, known as a transformation toughened zirconia. This zirconia ceramic is preferably stabilized with magnesium oxide, calcium oxide, cerium oxide and/or yttrium oxide. Because the preferred zirconia ceramic does not wear out the bores in which plungers formed from this zirconia ceramic reciprocate, the bores can be re-used without reconditioning. Stabilized zirconia ceramics having a hardness greater than 800 $Kg/mm^2$ (1000 on the Knoop scale) and a thermal expansion coefficient greater than $6\times10^{-6}/°$ C. are available from Coors Ceramic Co. and Kyocera Fine Ceramics.

Achieving an optimal minimum fuel leakage around the plunger during engine operation is critical. Since ceramics with low thermal expansion allow excessive leakage, only high thermal expansion ceramics are capable of maintaining fuel leakage within acceptable, or even desirable, parameters. The preferred ceramic materials are those with a thermal expansion coefficient greater than $6\times10^{-6}/°$ C., preferably 9 to $11\times10^{-6}/°$ C., and a hardness greater than 800 $Kg/mm^2$, preferably 900 to 1200 $Kg/mm^2$. The steel currently used to form high pressure fuel system plungers expands at a higher rate during fuel system operation than the preferred ceramic material. Therefore, the distance between the plunger outer diameter and the bore wall can be less when a ceramic plunger is used, which further minimizes fuel leakage from the clearance around the plunger. The thermal expansion coefficient of the ceramic selected for the plunger should preferably match as closely as possible that of the metal forming the fuel system component containing the bore in which the plunger reciprocates to maintain a substantially constant clearance or gap around the plunger during fuel system operation.

Figure 5:
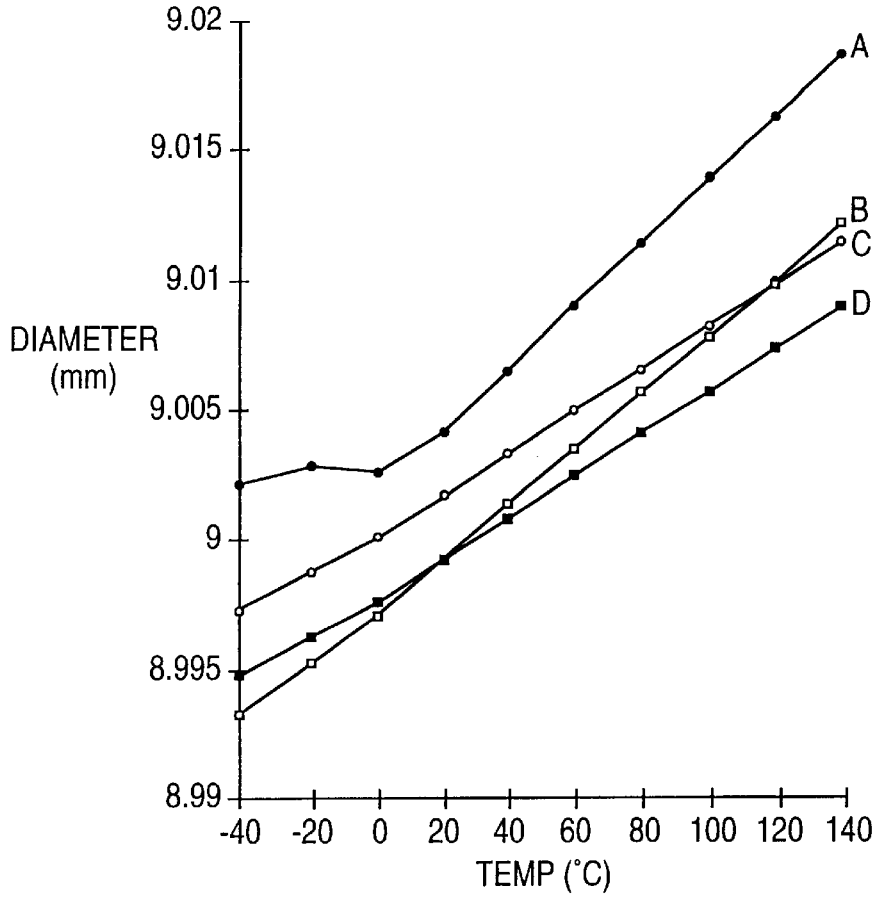
FIG. 5 presents graphically the changes in dimensions of a fuel injector body bore and timing plunger of FIG. 1 for different materials at different temperatures.

FIG. 5 compares the diameters of the injector body bore 24 (FIG. 1) with the diameters of a metal timing plunger currently in use and two ceramic plungers with differing diametral clearances over a range of engine operating temperatures. Curve A represents the diameter of the injector body bore over the range of temperatures studied. The injector body was formed of steel. Curve B shows the changes in plunger diameter when the timing plunger 14 is formed from steel, which is the material presently used. The diametral clearance between the steel timing plunger and the injector bore in the assembly tested was 5.0 microns. Curves C and D demonstrate diametral changes in timing plunger diameter for two ceramic timing plungers at different diametral clearances with the injector body. The diametral clearance between the ceramic timing plunger and the bore for the assembly represented by curve C was 2.5 microns, while the clearance for the curve D ceramic timing plunger assembly was 5.0 microns, the same as the clearance between the steel plunger and the injector body. As the temperature increased, the ceramic plunger diameter expanded at a slower rate than the steel plunger. This minimizes the incidence of contact between the plunger and the bore wall and, therefore, scuffing. FIG. 5 clearly demonstrates that a ceramic timing plunger in accordance with the present invention can have a smaller diametral clearance in the injector bore than the presently used steel plunger and still function effectively in the presence of the high axial and side loads applied to the timing plunger during engine operation.

Figure 6:
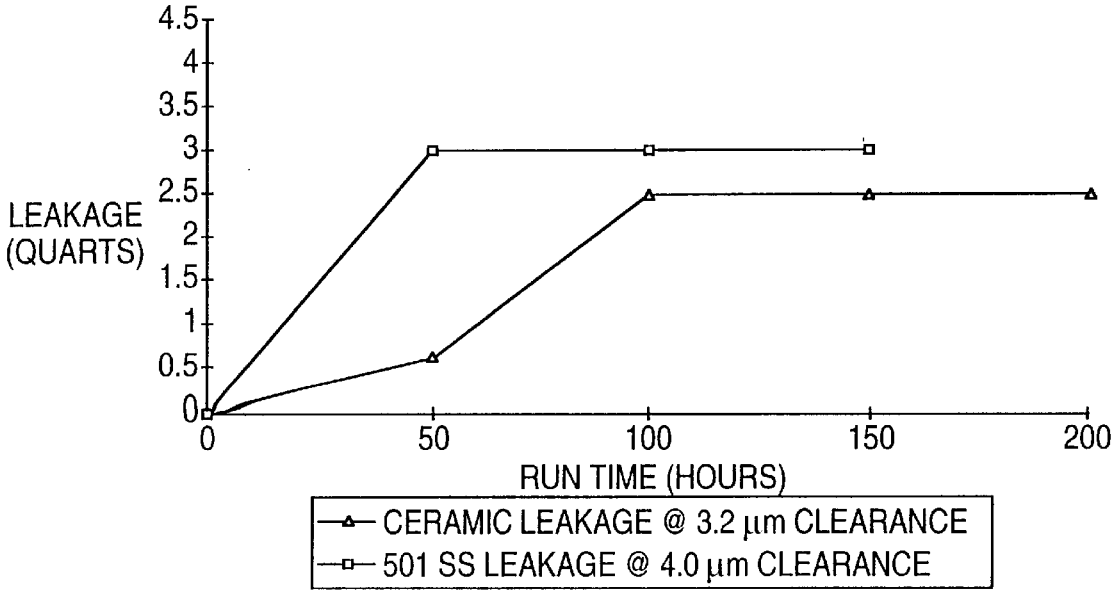
FIG. 6 is a comparison, in graphic form, of fuel leakage for a plunger formed from metal and a plunger formed from ceramic in accordance with the present invention in a fuel injector at high injection pressure.

FIG. 6 compares the fuel leakage around the timing plunger in a fuel injector of the type shown in FIG. 1 operating at an injection pressure of 34 ksi for a ceramic timing plunger in accordance with the present invention and for a metal plunger. Leakage levels that produce more than 5% fuel in the engine oil after 250 hours are considered to be excessive. The ceramic plunger was formed from a stabilized zirconia ceramic with a hardness greater than 800 $Kg/mm^2$ and a normalized thermal expansion of 0.67 and had a diametral clearance of 3.2 microns with the injector bore wall. The metal plunger was formed from a steel known as 501 steel with a hardness of 850–900 $Kg/mm^2$ and a normalized thermal expansion of 0.89 and had a diametral clearance of 4.0 microns with the injector bore wall. The difference in clearance was required to make the gap between the plunger and bore wall equivalent for the two materials during injector operation. Since the ceramic expands much less than the metal, the leakage would be much greater with the ceramic plunger if the two plungers had the same initial diametral clearance. The metal plunger demonstrated an unacceptably high level of leakage after only 50 hours, and this leakage level was maintained over the length of the test. Leakage around the ceramic plunger did not increase until between 50 and 100 hours, and the leakage level remained lower than with the metal plunger and within acceptable limits.

Figure 7:
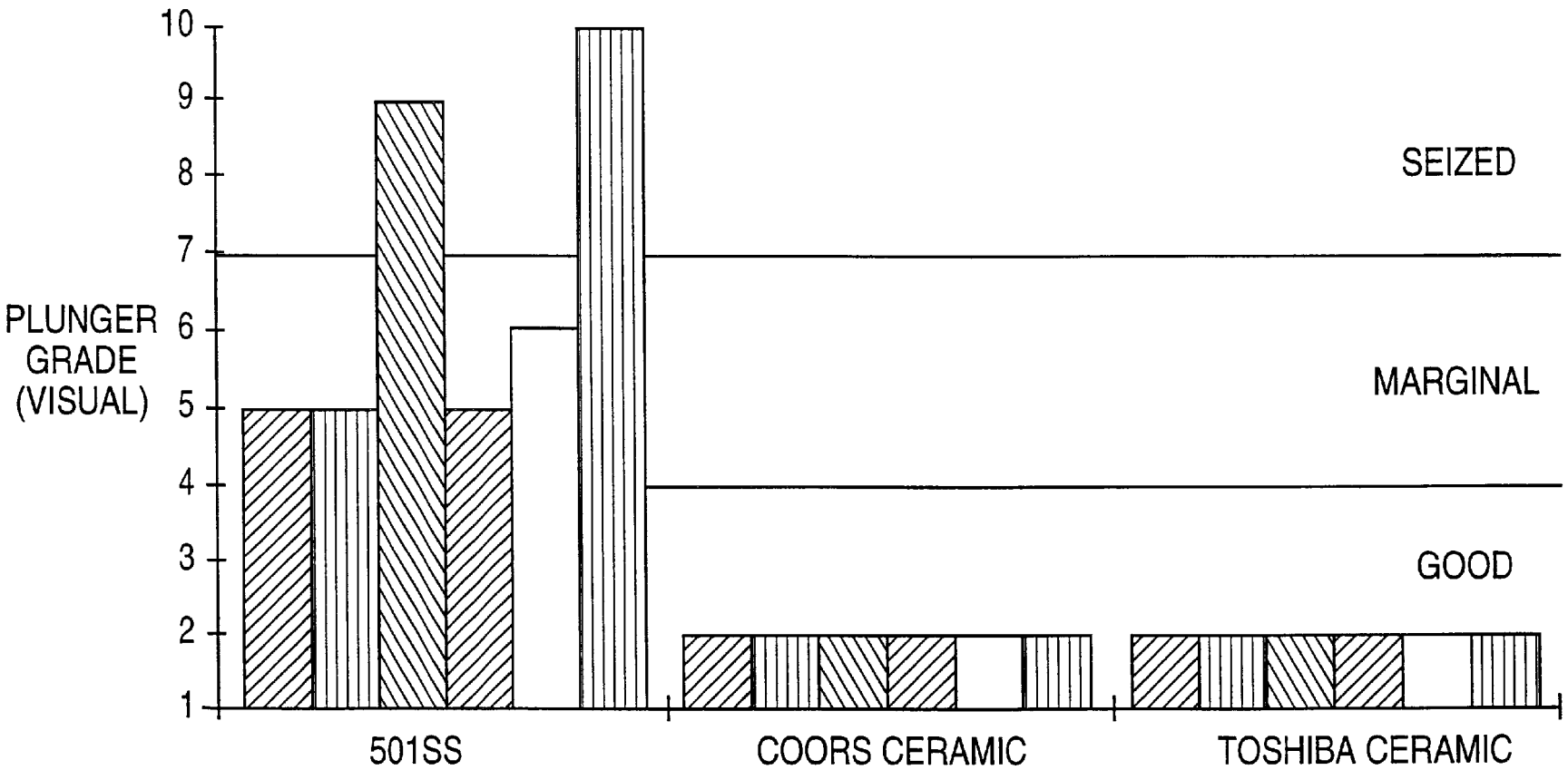
FIG. 7 presents a visual grade comparison of plungers made of ceramics from two sources and plungers made of steel after prolonged contact with a fluid with little or no lubricity.

FIG. 7 illustrates the results of a visual comparison of plunger grade for three groups of plungers, one made of 501 steel and two made of a zirconia ceramic from two different sources. These three groups of plungers were subjected to a 10 hour lube test with Viscor –16A, a very harsh fluid with little or no lubricity. The steel plunger visual grades ranged from 5 to 10, indicating marginal performance to seizure. The ceramic plungers' visual grades were less than 2, which indicated good plunger performance.

The cold start characteristics of engines with steel fuel system plungers and ceramic fuel system plungers according to the present invention were compared. At 0° F., using #1 diesel fuel, the engine with the metal fuel system plunger had trouble starting and wore down the battery cells after cranking for 30 seconds. The engine with the ceramic fuel system plunger started, unaided, after 28.5 seconds. Aided by ether, the metal fuel system plunger engine started in 3.2 seconds at 0° F. At 10° F., with #1 diesel fuel, the metal fuel system plunger engine took 9.8 seconds to start, while the ceramic fuel system plunger engine took 6.2 seconds to start. At 32° F., with #2 diesel fuel, the metal fuel system plunger engine took 3.4 seconds to start, while the ceramic fuel system plunger engine took 2.2 seconds to start.

Adhesive varnish is a problem with metal fuel system plungers not seen with ceramic fuel system plungers. During fuel injector operation, for example, the timing plunger does not fully enter the bore; a small portion of the plunger remains above the bore. This upper portion becomes coated with lubrication oil from the overhead. After extended engine operation, the temperature of the plunger increases, and the lubrication oil creates a varnish on the upper portion of the plunger. When the engine overhead is reset, the injector is reset by "bottoming the injector." To do this, the plunger is pushed down as far as possible into the injector bore and then backed up to a selected prescribed distance. The upper portion of the plunger that was varnished is forced into the bore during this process, which pushes varnish into the bore. The varnish then acts as an adhesive and causes the plunger to stick in the bore. Plungers formed of ceramic in accordance with the present invention do not demonstrate this varnish build-up. When steel and ceramic plungers were baked in used engine oil for four days at 350° F., the steel plungers demonstrated significant varnish, while the ceramic plungers did not show any signs of varnish.

Ceramic high pressure fuel system plungers with thermal expansion coefficients and hardness characteristics in the aforementioned range have survived extremely abusive bench and engine tests which have destroyed standard steel timing plungers.

High pressure fuel systems in which the metal plunger has been replaced by a ceramic plunger, particularly a zirconia ceramic plunger with the thermal expansion coefficient and hardness according to the present invention, have been unexpectedly characterized by a dramatic reduction in repairs. One of the objectives desired to be achieved by the ceramic fuel system plunger of the present invention was to reduce plunger scuffing, a major source of fuel system repairs. The reduction of plunger scuffing concomitantly reduces plunger wear, seizing and failure. The use of ceramic timing plungers in place of metal plungers in high pressure unit fuel injectors in the fuel systems of two models of engine developed by the assignee of the present invention did not merely decrease, but virtually eliminated, injector repairs caused by plunger scuffing. Such repairs are typically required when a fuel injector timing plunger sticks in the bore and cannot reciprocate, thus rendering the fuel injector inoperable. Since fuel system plunger scuffing and sticking have been virtually eliminated by forming the fuel system plungers from a high hardness, high thermal expansion zirconia ceramic in accordance with the present invention, injector repairs per hundred (RPH) have dropped to zero and have remained at zero in engines using these ceramic plungers.

Figure 8A:
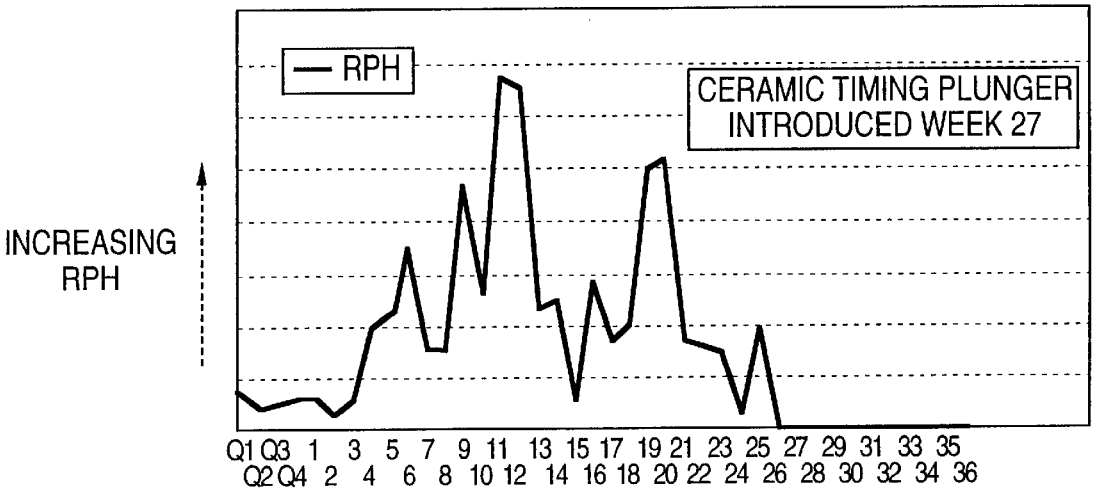
FIGS. 8*a* and 8*b* illustrate, graphically, the incidence of unit injector repairs per hundred for two different types of internal combustion engine before and after the introduction of ceramic timing plungers in accordance with the present invention.
Figure 8B:
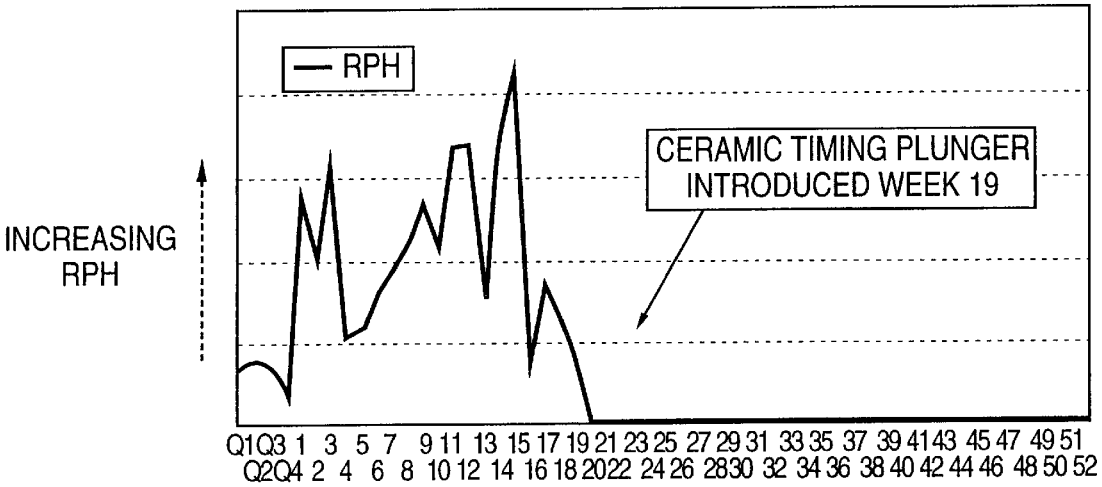

FIGS. 8*a* and 8*b* present, graphically, the incidence of unit injector repairs per hundred (RPH) for two different types of internal combustion engine in which ceramic timing plungers in accordance with the present invention replaced the metal timing plungers previously used in the high pressure unit injectors in these engines. In FIG. 8*a*, the ceramic timing plunger replaced the metal timing plunger beginning at week 27, and in FIG. 8*b*, the ceramic timing plunger replaced the metal timing plunger beginning at week 19. In both engine types the repairs for stuck and inoperable fuel injector timing plungers went unexpectedly to zero upon introduction of the ceramic and have remained there. This has substantially reduced warranty and repair costs.

High pressure fuel system plungers formed from ceramic as described herein have proved to be extremely reliable and have produced significant cost savings. The use of high hardness, high thermal expansion ceramic plungers to replace metal plungers in other high pressure fuel system components, for example fuel injection pumps, distributor pumps, accumulator pumps and the like, is expected to produce similar reductions in repair and warranty costs by providing a scuff-resistant, highly reliable plunger capable of operating at high pressures, under high axial and side loads, and in the presence of poor quality, reduced lubricity fuels efficiently.

INDUSTRIAL APPLICABILITY

The scuff-resistant ceramic plunger of the present invention will find its primary application as an integral component in a high pressure fuel system, wherever a plunger or piston is required to reciprocate at tight clearance within a bore, in a wide range of types of internal combustion engines, including medium and heavy duty and other types of compression ignition or diesel engines.

We claim:

1. A scuff and wear-resistant plunger for a high performance fuel system pump for supplying high pressure fuel directly or indirectly to the cylinders in an internal combustion engine, said plunger being operably positioned to reciprocate at a minimal optimum diametral clearance of 76 to 128 millionths of an inch within an axial bore in the fuel system pump body to deliver a controlled volume of trapped, high pressure fuel at desired intervals directly or indirectly to the one or more engine cylinders, wherein said plunger is made of a wear-resistant high hardness, high thermal expansion ceramic material having a thermal expansion coefficient greater than $6\times10^{-6}/°$ C. and a hardness greater than 800 $Kg/mm^2$, and the plunger is sized relative to the axial bore to maintain said optimum diametral clearance therewith to reciprocate freely within the bore without sticking during fuel system pump operation.

2. The scuff and wear-resistant plunger described in claim 1, wherein said plunger is formed of a ceramic selected from the group consisting of zirconia, alumina-zirconia and alumina ceramics having a thermal expansion coefficient greater than $6\times10^{-6}/°$ C. and a hardness greater than 800 $Kg/mM^2$.

3. The scuff and wear-resistant plunger described in claim 2, wherein the plunger is formed from a transformation toughened zirconia ceramic.

4. A scuff and wear-resistant, high thermal expansion, high hardness zirconia ceramic plunger for an internal combustion engine fuel system component, wherein said plunger is operably positioned entirely within an axial bore in the fuel system component to deliver a selected amount of high pressure fuel directly or indirectly to the engine combustion chamber, and said timing plunger is capable of reciprocal axial movement within the axial bore in the fuel system component under a high axial load and an additional side load on the plunger and is assembled into a bore with a diametral clearance of 76 to 128 millionths of an inch within said axial bore to maintain a desired optimum minimal diametral operating clearance while avoiding excessive fuel leakage and to maintain efficient plunger function without scuffing or sticking under the high axial, side and pressure loads and variable quality fuels encountered in the fuel system operating environment, wherein said zirconia ceramic plunger has a thermal expansion coefficient greater than $6\times10^{-6}/°$ C. and a hardness greater than 800 $Kg/mm^2$.

5. The scuff and wear-resistant plunger described in claim 4, wherein said plunger is formed of a transformation toughened zirconia ceramic.

6. A fuel system for supplying fuel under high pressure to an internal combustion engine, comprising a fuel system component containing a bore into which fuel is supplied periodically and from which fuel is discharged at high pressure directly or indirectly into the cylinders of the internal combustion engine, and a plunger operably positioned to reciprocate within said bore to form a variable volume fuel pressurization chamber, said plunger having a diameter slightly smaller than the diameter of said bore to form an optimum diametral clearance that is large enough to permit adequate lubrication between the external surface of said plunger and the surrounding inner surface of said bore and yet small enough to preclude excessive fuel leakage, wherein said plunger is formed of a wear-resistant high hardness, high thermal expansion ceramic material having a thermal expansion coefficient greater than $6\times10^{-6}/°$ C. and a hardness greater than 800 $Kg/mm^2$, and said plunger being sized relative to said bore to maintain said optimum diametral clearance therewith to reciprocate freely within said bore without sticking during fuel system pump operation.

7. A fuel system as defined by claim 6, wherein said fuel system component is a unit injector including an injector body having an injector nozzle located at one end for spraying fuel into an engine cylinder, and wherein said plunger is a metering plunger and said variable volume chamber is located within said bore between said injector nozzle and said plunger for receiving fuel which is pressurized and directed to said injector nozzle.

8. A fuel system as defined by claim 7, further includes a timing plunger located in said bore on the side of said metering plunger opposite said injector nozzle to form a variable volume timing chamber between said metering plunger and said timing chamber into which a variable amount of fluid can be trapped on a cycle-by-cycle basis to cause the timing of fuel injection to be variable dependent on the volume of fluid trapped in said timing chamber.

9. A fuel system as defined by claim 8, wherein said timing plunger is formed of a wear-resistant high hardness, high thermal expansion ceramic material having a thermal expansion coefficient greater than $6\times10^{-6}/°$ C. and a hardness greater than 800 $Kg/mm^2$.

10. A fuel system as defined by claim 6, wherein said fuel system component is an accumulator fuel pump for a multi-cylinder internal combustion engine including an accumulator for receiving and storing the fuel discharged under high pressure from said bore;

a distributor for successively directing fuel stored in said accumulator to the engine cylinders in timed sequence relative to engine operation; and a high pressure pump containing a plurality of said bores and a plurality of said plungers mounted for reciprocating motion within said bores respectively; each said plunger having a diameter that is smaller than the diameter of said bore to form a diametral clearance this is large enough to permit adequate lubrication between the external surface of said plunger and the surrounding inner surface of said bore and yet small enough to preclude excessive fuel leakage.

11. A fuel system as defined by claim 10, wherein said high pressure pump includes a camshaft having a plurality of cams and a plurality of corresponding tappets for reciprocally driving said plungers to cause high pressure fuel to be discharged from each said bore into said accumulator.

12. A fuel system as defined by claim 11, wherein said distributor includes a rotatable distributor shaft for directing fuel from said accumulator to the engine cylinders and wherein said camshaft is connected to rotatably drive said rotatable distributor shaft.

13. A fuel system as defined in claim 6, wherein said fuel system component is a fuel distributor pump including a rotatable shaft, and rotatable shaft containing said bore, said bore being oriented axially within said rotatable shaft, said plunger is positioned within said bore, and said fuel distributor pump including a solenoid valve for controlling the generation of fuel injection pressures within said bore.

14. A fuel system as defined in claim 13, further including a second bore for receiving a timing piston adapted to be actuated to control fuel delivery by said axial piston, said timing piston having a diameter to form a diametral clearance that is large enough to permit adequate lubrication between the external surface of said plunger and the surrounding inner surface of said bore and yet small enough to preclude excessive fuel leakage, said timing piston is formed of a wear-resistant high hardness, high thermal expansion ceramic material having a thermal expansion coefficient greater than $6\times10^{-6}/°$ C. and a hardness greater than 800 $Kg/mm^2$.

15. A fuel system as defined in claim 6, wherein said fuel system component is a solenoid valve-controlled radial piston fuel distributor pump, characterized by a high level of transmission-element rigidity, coupled with a low dead volume in the high pressure zone of said pump and a high rate of delivery, said pump including a rotating distributor shaft containing a plurality of said bores radially oriented and further including a plurality of said plungers reciprocally mounted within said radially oriented bores, respectively, to form high pressure delivery pistons, each said plunger having a diametral clearance within the corresponding radially oriented bore that is slightly smaller than the diameter of said bore to form a diametral clearance that is large enough to permit adequate lubrication between the external surface of said high pressure delivery piston and the surrounding inner surface of said bore and yet small enough to preclude excessive fuel leakage.

16. A fuel system as defined in claim 15, wherein said pump further includes a timing device bore and a timing device piston for controlling fuel injection timing, said timing device piston being formed of a wear-resistant high hardness, high thermal expansion ceramic material having a thermal expansion coefficient greater than $6\times10^{-6}/°$ C. and a hardness greater than 800 $Kg/mm^2$, and said timing device piston is sized relative to the axial bore to maintain said optimum diametral clearance therewith to allow said timing device piston to reciprocate freely within the bore without sticking during fuel system pump operation.

17. A fuel system as defined in claim 6, wherein said fuel system component is an electronically controlled rotary distribution pump having radial pumping elements and a centralized control valve fixed in place, said pump includes a stationary hydraulic head assembly containing a plurality of said bores and a plurality of said plungers mounted in said bores respectively to form high pressure plungers, each said high pressure plunger having a diameter that is large enough to permit adequate lubrication between the external surface of said plunger and the surrounding inner surface of said bore and yet small enough to preclude excessive fuel leakage, each said high pressure plunger being formed of a wear-resistant high hardness, high thermal expansion ceramic material having a thermal expansion coefficient greater than $6\times10^{-6}/°$ C. and a hardness greater than 800 $Kg/mm^2$.

18. A fuel system as defined in claim 17, further including a transfer pump and a cam ring having an external profile for driving said transfer pump, said transfer pump containing a transfer pump bore and a transfer pump piston mounted therein with a diameter that is slightly smaller than the diameter of the bore to form a diametral clearance this is large enough to permit adequate lubrication between the external surface of said transfer pump piston and the surrounding inner surface of said bore and yet small enough to preclude excessive fuel leakage, said transfer pump piston been formed of a wear-resistant high hardness, high thermal expansion ceramic material having a thermal expansion coefficient greater than $6\times10^{-6}/°$ C. and a hardness greater than 800 $Kg/mm^2$.

* * * * *

UNITED STATES PATENT AND TRADEMARK OFFICE

CERTIFICATE OF CORRECTION

PATENT NO. : 6,149,073
DATED : November 21, 2000
INVENTOR(S) : Dan Hickey; J. Victor Perr; David M. Rix; Joseph C. Bentz; Thomas M. Yonushonis; Malcolm G. Naylor; Katsuhiro Shinosawa; John T. Carroll, III.

It is certified that error appears in the above-identified patent and that said Letters Patent is hereby corrected as shown below:

Drawings,

Sheet 2, Fig. 2, the reference numeral -- 51 -- should be applied to the distributor device; the reference numeral -- 51*a* -- should be applied to the rotary distributor; the reference numeral -- 53*a*—and -- 53*b* -- should be applied to the continuing multiple cavities; the reference numeral -- 55—should be applied to the metering device; reference numeral -- 57 -- should be applied to the high pressure fuel pump; and reference numeral "74" should be deleted and replaced with numeral reference -- 74 -- applied to the accumulator, as follows:

FIG. 2

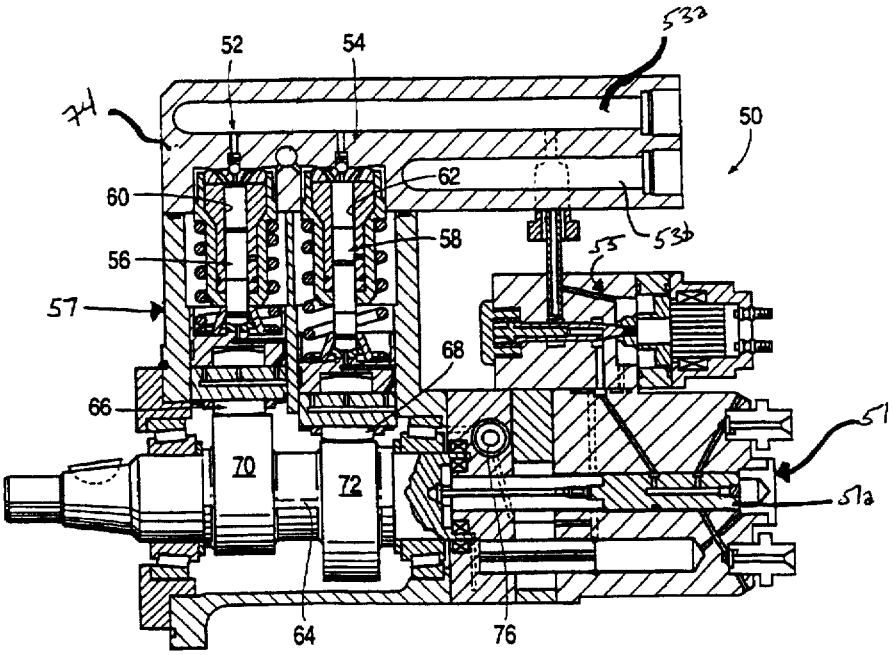

UNITED STATES PATENT AND TRADEMARK OFFICE

CERTIFICATE OF CORRECTION

PATENT NO. : 6,149,073 
DATED : November 21, 2000
INVENTOR(S) : Dan Hickey; J. Victor Perr; David M. Rix; Joseph C. Bentz; Thomas M. Yonushonis; Malcolm G. Naylor; Katsuhiro Shinosawa; John T. Carroll, III.

It is certified that error appears in the above-identified patent and that said Letters Patent is hereby corrected as shown below:

Sheet 3, Fig. 3a, the reference numeral -- 167 -- should be applied to the cam mechanism; the reference numeral -- 169 -- should be applied to the high pressure chamber; the reference numeral "60" should read -- 160 --; the reference numeral "62" should read -- 162 --; the reference numeral "64" should read -- 164 --; the reference numeral "66" should read -- 166 --; the reference numeral "68" should read -- 168 --; the reference numeral "70" should read -- 170 --, as follows:

FIG. 3a

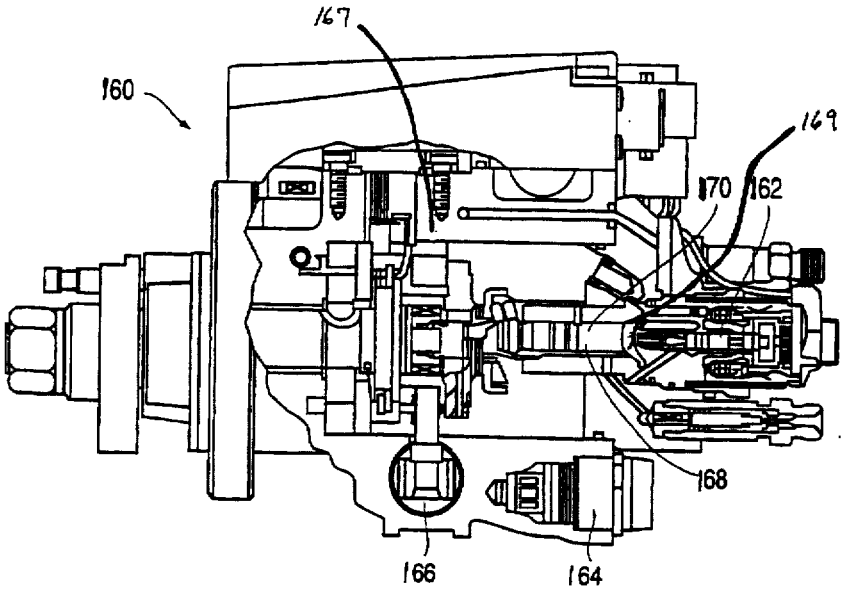

UNITED STATES PATENT AND TRADEMARK OFFICE

CERTIFICATE OF CORRECTION

PATENT NO. : 6,149,073
DATED : November 21, 2000
INVENTOR(S) : Dan Hickey; J. Victor Perr; David M. Rix; Joseph C. Bentz; Thomas M. Yonushonis; Malcolm G. Naylor; Katsuhiro Shinosawa; John T. Carroll, III.

It is certified that error appears in the above-identified patent and that said Letters Patent is hereby corrected as shown below:

Sheet 4, Fig. 3b, the reference numeral "3b" should read -- 3c --; the reference numeral -- 95 -- should be applied to the needle valve through passage, as follows:

FIG. 3b

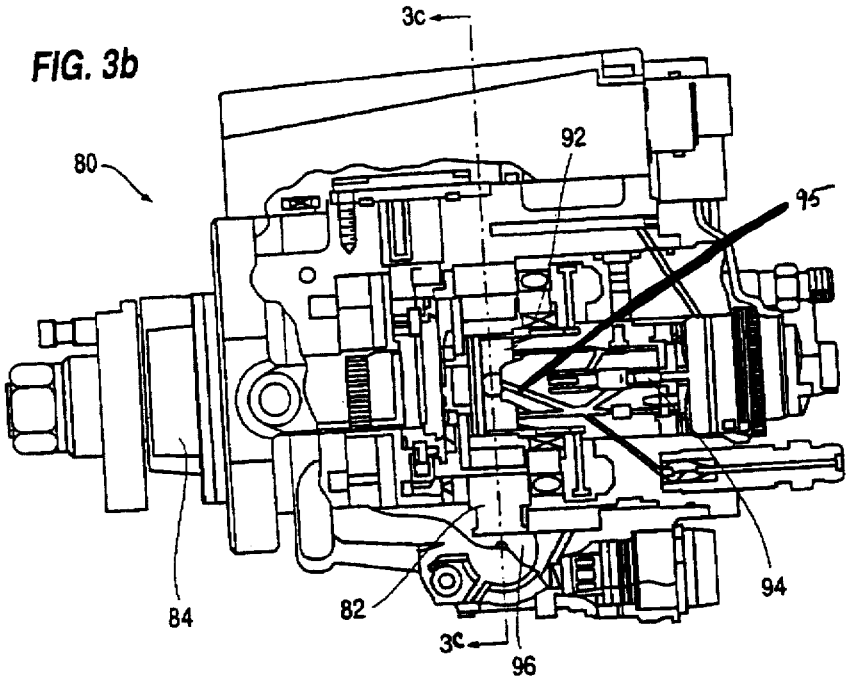

UNITED STATES PATENT AND TRADEMARK OFFICE

CERTIFICATE OF CORRECTION

PATENT NO. : 6,149,073
DATED : November 21, 2000
INVENTOR(S) : Dan Hickey; J. Victor Perr; David M. Rix; Joseph C. Bentz; Thomas M. Yonushonis; Malcolm G. Naylor; Katsuhiro Shinosawa; John T. Carroll, III.

It is certified that error appears in the above-identified patent and that said Letters Patent is hereby corrected as shown below:

Sheet 4, Fig. 3c, the reference numeral -- 93 -- should be applied to the centrally located high pressure chamber; the reference numeral "96" should be deleted and replaced with reference numeral -- 96 -- applied to the timing device delivery piston; the reference numeral -- 97 -- should be applied to the bore, as follows:

FIG. 3c

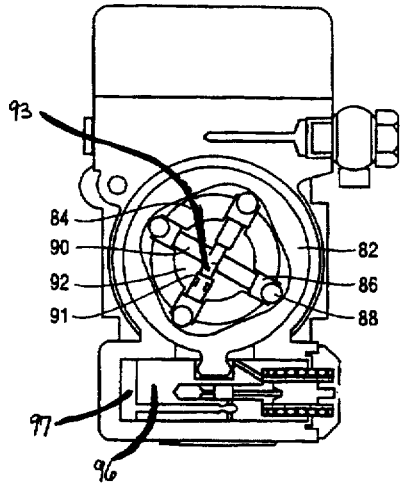

UNITED STATES PATENT AND TRADEMARK OFFICE

CERTIFICATE OF CORRECTION

PATENT NO. : 6,149,073
DATED : November 21, 2000
INVENTOR(S) : Dan Hickey; J. Victor Perr; David M. Rix; Joseph C. Bentz; Thomas M. Yonushonis; Malcolm G. Naylor; Katsuhiro Shinosawa; John T. Carroll, III.

It is certified that error appears in the above-identified patent and that said Letters Patent is hereby corrected as shown below:

Sheet 5, Fig. 4a, the reference numeral -- 119 -- should be applied to the transfer pump tappet; the reference numeral -- 121 -- should be applied to the lever; the reference numeral "4b" should be deleted and replaced with reference numeral -- 4b --, as follows:

FIG. 4a

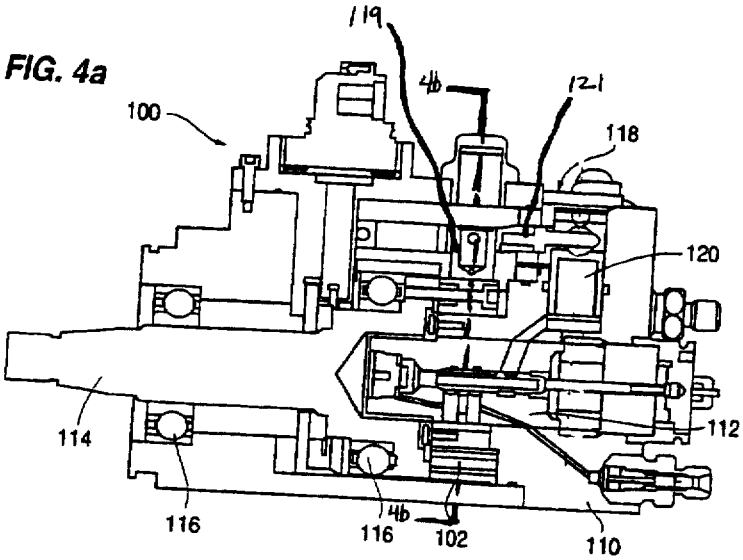

UNITED STATES PATENT AND TRADEMARK OFFICE

CERTIFICATE OF CORRECTION

PATENT NO. : 6,149,073
DATED : November 21, 2000
INVENTOR(S) : Dan Hickey; J. Victor Perr; David M. Rix; Joseph C. Bentz; Thomas M. Yonushonis; Malcolm G. Naylor; Katsuhiro Shinosawa; John T. Carroll, III.

It is certified that error appears in the above-identified patent and that said Letters Patent is hereby corrected as shown below:

Specification,
Column 5,
Lines 64, 66, the text reading "metering plunger 12", each occurrence, should read -- timing plunger 14 --.

Column 6,
Line 1, the text reading "timing plunger 14" should read -- metering plunger 12 --.

Column 7,
Line 55, reference numeral "60" should read -- 160 --;
Line 65, "closing" should read -- The closing --;

Column 8,
Line 8, delete "that".

Signed and Sealed this

Sixth Day of November, 2001

*Attest:*

Nicholas P. Godici

NICHOLAS P. GODICI
*Acting Director of the United States Patent and Trademark Office*

*Attesting Officer*